United States Patent [19]

Ludder

[11] 3,964,635

[45] June 22, 1976

[54] RECESSED, RIM-LOCKING CONTAINER CLOSURE

[75] Inventor: Rodney E. Ludder, Glen Head, N.Y.

[73] Assignee: Owens-Illinois, Inc., Toledo, Ohio

[22] Filed: Dec. 26, 1973

[21] Appl. No.: 427,985

[52] U.S. Cl. ..... 220/306

[51] Int. Cl.[2] ..... B65D 43/10

[58] Field of Search ..... 220/60 R, 306

[56] References Cited

UNITED STATES PATENTS

| | | | |
|---|---|---|---|
| 3,173,571 | 3/1965 | Cserny et al. | 220/60 R X |
| 3,302,822 | 2/1967 | Edwards | 220/60 R X |
| 3,409,123 | 11/1968 | McCormick | 220/306 |
| 3,583,596 | 6/1971 | Brewer | 220/306 |
| 3,643,830 | 2/1972 | Kinney | 220/60 R X |
| 3,773,207 | 11/1973 | Dokoupil et al. | 220/60 R X |
| 3,883,036 | 5/1975 | Mahaffy et al. | 220/306 |

*Primary Examiner*—George E. Lowrance
*Assistant Examiner*—Douglas B. Farrow
*Attorney, Agent, or Firm*—Thomas A. Meehan; Edward J. Holler

[57] ABSTRACT

A recessed, rim-locking closure for attachment to a wide-mouth container of the type having an externally projecting curled rim or bead surrounding the open mouth thereof, such as the well-known one-piece nestable container produced from thermoplastic sheet material by a thermoforming process, the peripheral vertical wall surrounding the recessed central portion of the closure having a series of radially outwardly projecting lugs spaced apart therearound, each lug having a lower portion which is tapered upwardly and outwardly to facilitate centering of the closure on the container by mechanical closure-applicating equipment, the lugs also having a substantially vertical upper section to frictionally engage the inside of the mouth of the associated container to improve the resistance of the closure to turning relative to the container. Such a closure may be made of one-piece thermoplastic material by thermoforming a thermoplastic sheet material of a suitable composition, preferably in a female mold.

5 Claims, 5 Drawing Figures

RECESSED, RIM-LOCKING CONTAINER CLOSURE

BACKGROUND OF THE INVENTION

As is well understood in the packaging art, many relatively short shelf-life products, especially dairy products such as cottage cheese, yogurt, sour cream and the like, may be satisfactorily and advantageously packaged in relatively inexpensive, frusto-conically shaped, wide-mouth nestable containers in which the mouth is surrounded by an annular externally projecting curled rim or bead. At one time, two-piece waxed paperboard containers were very widely used for such purposes and in recent years one-piece seamless containers produced from a suitable thermoplastic sheet material by thermoforming have also gained a substantial measure of popularity for such purposes. In any case, any such container must be suitably closed by a separate closure member after the intended product has been packaged therein, and it is important, for economic reasons, that such closure be of such a type that it can be rapidly applied to a filled container, by mechanical closure-applicating equipment, in order to permit the rapid capping of a great number of such containers.

One-piece thermoplastic closures of the recessed rim-locking type are relatively inexpensive and have proven to be functionally satisfactory for the closing of externally rimmed, nestable cottage cheese and other food product containers of the type described above. However, to provide the radially outermost skirt of such a closure with inwardly projecting locking beads of sufficient depth to securely engage the rim of the associated container, it has proven to be quite desirable to form such closures in a female die, where the natural shrinkage of the formed closure, on cooling, will cause the closure to shrink away from the die, thereby facilitating removal of closure from the die in spite of the outwardly projecting locking bead forming portions of the die. In order to get the sheet from which such closure is formed to draw properly into such a die, however, it has been found necessary to maintain a ratio of no more than about 1:1 between the depth of the outer closure skirt and the annular width of the web that extends between such skirt and the peripheral wall which surrounds the recessed central portion of the closure. Because of the substantial width of such web, however, difficulty has been experienced in properly centering the recessed portions of such closures on the open mouths of filled containers when applying such closures mechanically. Likewise, because of the width of such web, heretofore such closures were not always resistant to turning relative to a filled container, when assembled thereto, since the frictional contact between the closure and the container was inherently limited to the contact at the outer skirt of the closure.

GENERAL DESCRIPTION OF THE INVENTION

In accordance with the present invention, however, there is provided a recessed, rim-locking closure for a wide-mouth container with an externally projecting rim or bead surrounding the mouth thereof, such closure being of a design suitable to permit it to be manufactured from thermoplastic material in one-piece configuration by thermoforming a thermoplastic sheet material in a female die, such closure having improved centering characteristics during capping of a filled container and thereby being suitable for application by mechanical applicating devices, such closure also being adapted to frictionally engage the inside of the associated container for added resistance to turning relative thereto. A closure according to the present invention has the usual degree of lateral spacing between the outer skirt and the recessed central portion of the closure to permit proper forming of the closure by thermoforming in a female die, the improved centering characteristics and resistance to turning of such closure being obtained by a circumferentially spaced apart series of arcuately short, radially outwardly projecting, suitably contoured lugs on the peripheral wall which surrounds the recessed central portion of the closure. These lugs, which do not interfere with proper thermoforming of such a closure, each have a lower tapered portion which extends upwardly and outwardly from the recessed central panel of the closure and which aids in the centering of the closure on a container during capping. Each of these closure lugs also has an upper, generally vertical section which is adapted to frictionally contact the inside of the mouth of a capped container to increase the resistance of the closure to turning on the container.

Accordingly, it is an object of the present invention to provide an improved container closure of the recessed, rim-locking type. More particularly, it is an object of the present invention to provide a one-piece, recessed, rim-locking container closure which can be thermoformed from thermoplastic sheet material in a female die and which has improved centering characteristics, relative to the associated container, when being applied thereto. More particularly yet, it is an object of the present invention to provide such a closure which will also be adapted to frictionally engage the inside of the mouth of the associated container, when in place thereon, for improved resistance to turning relative thereto. It is also an object of the present invention to provide a package comprising a wide-mouth container with an externally projecting rim or bead and a female die-thermoformed, plastic one-piece closure in place over the mouth of such container, such closure being of the recessed rim-locking type and contacting the inside of the container mouth at a plurality of circumferentially spaced apart points for improved frictional resistance to turning relative to the container.

For a further understanding of the present invention and the objects thereof, attention is directed to the drawing and the following description thereof, to the detailed description of the invention and to the appended claims.

DETAILED DESCRIPTION OF THE INVENTION

Figure 1:
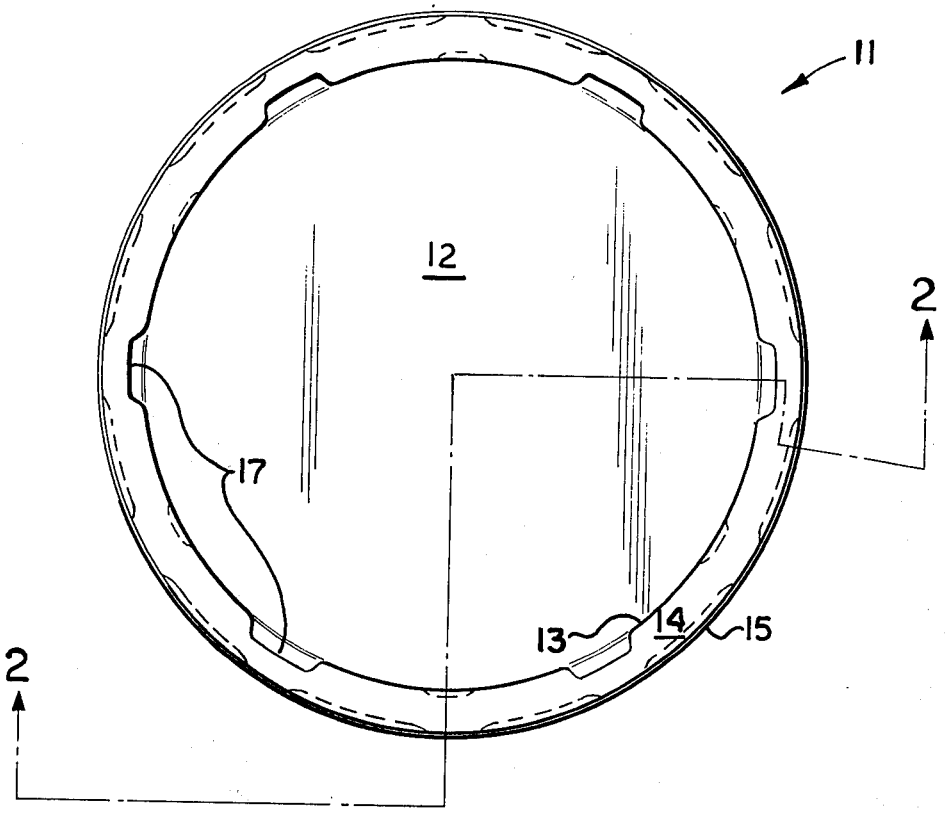
FIG. 1 is a horizontal plan view of a preferred embodiment of a closure in accordance with the present invention.
Figure 2:
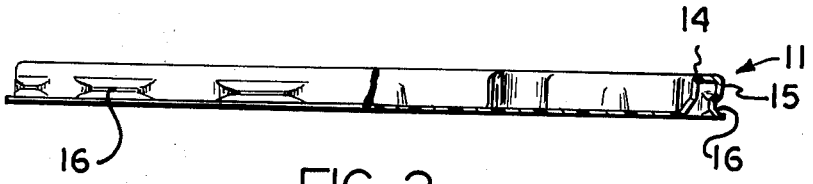
FIG. 2 is a sectional view taken on line 2—2 of FIG. 1.

A closure in accordance with the present invention, as identified generally by reference character 11 in the drawing, may be made in one-piece by thermoforming a sheet of a suitable thermoplastic material, preferably in a female die for reasons which will be hereinafter explained more fully. Impact resistant grades of thermoplastic material are preferred for such closures, for example, medium impact polystyrene for closures for cottage cheese and yogurt containers and ABS for soft margarine containers because of its good grease resistance.

In its construction, closure 11 comprises a central panel portion 12 which is adapted to substantially span the mouth of the container to which such closure is adapted to be affixed, as will be hereinafter described more fully. So that central panel portion 12 of closure 11 will be recessed within the head space of the associated container, to reduce the volume of air in the head space of the container and to thereby preserve the freshness of the packaged product, as is well understood in the art, panel portion 13 is surrounded by a peripheral wall portion 13 which extends axially outwardly from central panel portion 12 for a distance substantially equal to the distance it is desired to recess central panel within the mouth of the associated container. Peripheral wall portion 13, in turn, is surrounded by an annular portion 14 which is attached thereto above the juncture of panel portion 12 with wall portion 13 and which extends laterally outwardly from wall portion 13. Annular portion 14 is sized and positioned so as to be adapted to rest on the beaded or flanged rim portion of the container to which it is intended to be affixed, and has attached thereto, at a location laterally outwardly of its juncture with wall portion 14, a peripheral skirt portion 15 which extends axially downwardly, or, in other words, back toward the plane of central panel portion 12.

Figure 3:
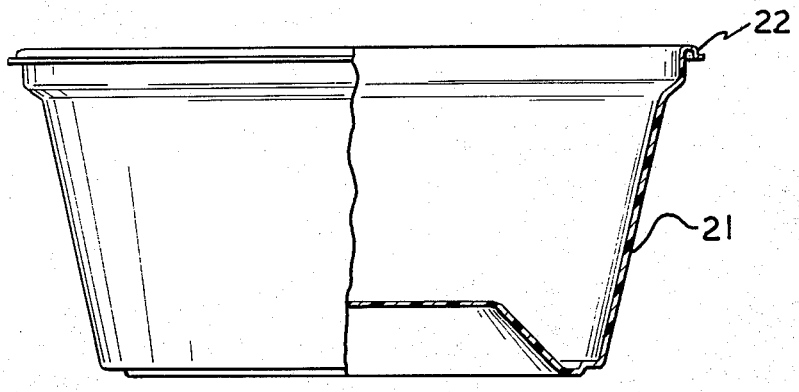
FIG. 3 is a vertical elevation view, partly in section, of a typical nestable container to which the closure of FIGS. 1 and 2 may be applied.

Closure 11 is adapted to be affixed to a wide-mouth, thin wall container such as the conventional one-piece, seamless container of nestable shape which is identified by reference character 21 in FIG. 3. Such containers are quite popular for many short shelf life food packaging applications, and they may be produced relatively inexpensively from a sheet of a suitable thermoplastic material, such as general purpose polystyrene for cottage cheese containers, by known types of thermoforming. A container of this type is customarily provided with an annular, laterally outwardly projecting rim 22 reinforcing and surrounding the open mouth thereof, and comparable two-piece paperboard containers have an equivalent projection, usually in the form of a curled bead of generally circular cross-section.

Figure 4:
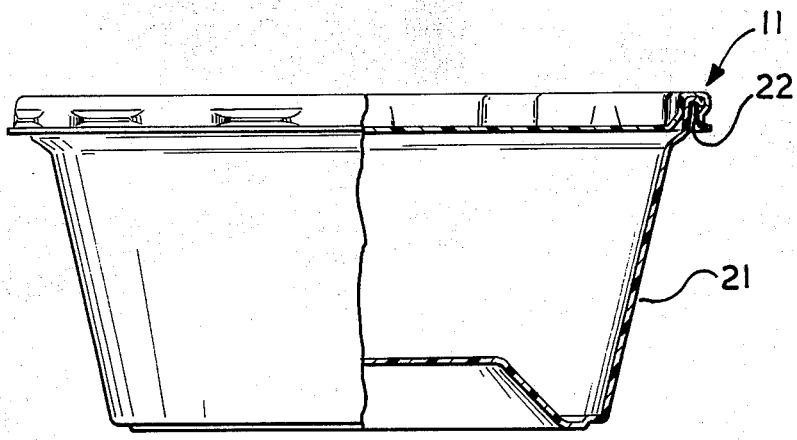
FIG. 4 is a view similar to FIG. 3 showing the closure of FIGS. 1 and 2 affixed to the container of FIG. 3.
Figure 5:
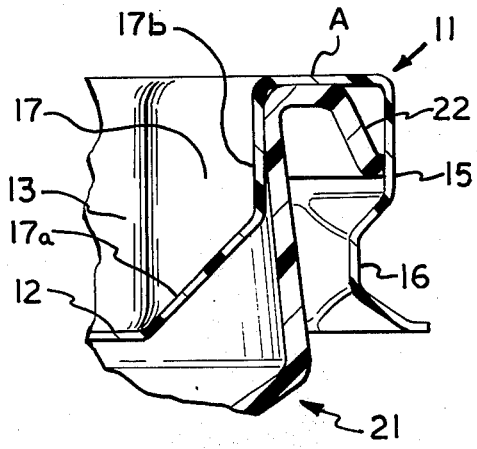
FIG. 5 is a fragmentary sectional view, at an enlarged scale, illustrating more clearly the manner in which the closure of FIGS. 1 and 2 engages the container of FIG. 3 when it is affixed thereto.

To firmly retain closure 11 in place on the rimmed mouth of the container 21 to which it is adapted to be affixed, as is shown in FIGS. 4 and 5, where the product to be packaged in container 21 is omitted for the sake of clarity, the peripheral skirt portion 15 of the closure is provided with a series of spaced apart, inwardly projecting beads 16. Beads 16 are located near the lower or free end of skirt portion 15, below the plane of the lowermost portion of the rim 22 which surrounds the mouth of the associated container 21 when the closure is affixed thereto, and the radial distance from the vertical central axis of the assembled container and closure to the radially innermost portion of beads 16 is at least slightly less than the radial distance to the outermost portion of the rim 22 of container 21. This relationship between such radial distances results in interference between the beads 16 and the container rim 22 thereby making it possible for the beads to securely grip the container rim when assembled thereto, the inherent flexible nature of the thin skirt portion 15 making it possible to force the closure on to the container mouth by capping equipment of conventional character. In fact, to obtain optimum rim gripping or locking properties, closure 11 should preferably be formed in a female mold, since normal shrinkage of the formed closure, on cooling, will make it possible to provide beads 16 of greater radial extent without interfering with removal of the closure from the mold.

In order to properly thermoform a closure 11 as described above, it is important to maintain the ratio of the radial or lateral extent of annular portion 14 to the axial extent of skirt portion 15 at not substantially less than about 1:1; otherwise, the sheet from which such closure is formed will not properly fill the mold when using conventional thermoforming practices. Such lateral extent of annular portion 14 is normally considerably greater than the lateral extent of the container rim over which it is adapted to lie, making it difficult to properly center a closure on its associated container during capping, especially when using high-speed mechanical capping devices. To overcome such centering difficulties, peripheral wall portion 13 of closure 11 is provided with a circumferentially spaced apart series of outwardly projecting lugs 17 which project into the space between wall portion 13 and skirt portion 15, terminating short of skirt portion by a distance sufficient to receive rim portion 22 of container 21. Such lugs, which do not interfere with proper thermoforming of closure 11, preferably have at least a lowermost portion of substantial axial extent, identified as portion **17*a* in the drawing, which tapers at a substantial angle, e.g. of the order of 40°–45°, upwardly and outwardly from the juncture of wall portion 13 with panel portion 12 to further aid in the centering of closure 11 on container 21. Lugs 17 can also advantageously be provided with an upper portion of substantial axial extent, identified as portion 17*b* in the drawing, which has a generally vertical orientation for frictional engagement with the inside of the mouth of container 21**. This increases the frictional resistance to turning of the closure on the container to which it is affixed over that characteristic of other rim-gripping closures which engage the container only at points on the outside thereof.

The best mode known to me to carry out this invention has been described above in terms sufficiently full, clear, concise and exact as to enable any person skilled in the art to make and use the same. It is to be understood, however, that it is within my contemplation that certain modifications of the above-described mode of practicing the invention can be made by a skilled artisan without departing from the scope of the invention and it is, therefore, desired to limit the invention only in accordance with the appended claims.

I claim:

1. A closure adapted to be affixed to the mouth of a container of the type having laterally outwardly projecting means disposed in an annular pattern surrounding said mouth, said closure being integrally formed by thermoforming from sheet-like thermoplastic material in a female mold and comprising in combination: a laterally extending central panel; an axially extending peripheral wall attached to, surrounding and extending upwardly from said central panel; an annular member attached to said peripheral wall at a location above the juncture of said peripheral wall and said central panel, said annular member extending laterally outwardly from said peripheral wall; and a peripheral skirt attached to said annular member at a location laterally outwardly of the juncture of said annular wall and said peripheral wall, said peripheral skirt extending axially downwardly, said skirt being provided with laterally inwardly projecting means which are adapted to securely engage the outwardly projecting means surrounding the mouth of the container to retain the closure in place with respect to the container to which it is adapted to be affixed, said peripheral wall being provided with a circumferentially spaced apart series of lugs which project radially outwardly thereform toward said peripheral skirt and which terminate short of said peripheral skirt, said peripheral skirt being attached to the annular member at a location spaced outwardly of the juncture of the annular member and the peripheral wall by a distance which is not substantially less than the axial depth of the peripheral skirt.

2. A closure according to claim 1, each of said lugs having a lowermost portion of substantial axial extent which tapers upwardly and outwardly from the lowermost portion of said lug to facilitate the centering of such closure on the container when it is being affixed thereto.

3. A closure according to claim 2 in which each of said lugs also has an upper portion of substantial axial extent extending upwardly from said lower most portion and being generally vertically oriented for frictional contact with the inside of the mouth of the container after said closure has been affixed thereto.

4. In combination: a wide mouth container having laterally outwardly projecting means disposed in an annular pattern surrounding said mouth; and a closure affixed to the mouth of said container, said closure being integrally formed by thermoforming from sheet-like thermoplastic material in a female mold and comprising a laterally extending central panel disposed within said container mouth below the top thereof and substantially spanning said mouth, an axially extending peripheral wall attached to surrounding and extending upwardly from said central panel to the top of the mouth of said container, an annular member attached to said peripheral wall above the juncture of said peripheral wall and said central panel, said annular member extending laterally outwardly from said peripheral wall and lying on the top of the mouth of said container, and a peripheral skirt attached to said annular member at a location laterally outwardly of the juncture of said annular wall and said peripheral wall, said peripheral skirt extending axially downwardly below and laterally outwardly of the laterally outwardly projecting means of the container, said skirt being provided with laterally inwardly projecting means which engage the laterally outwardly projecting means of the container to retain the closure in place with respect to the container, said peripheral wall being provided with a circumferentially spaced apart series of lugs which project radially outwardly therefrom toward the inside of the mouth of said container, said peripheral skirt being attached to the annular member at a location spaced outwardly of the juncture of the annular member and the peripheral wall by a distance which is not substantially less than the axial depth of the peripheral skirt.

5. The combination according to claim 4 wherein each of said lugs of said closure has an upper portion of substantial axial extent, of generally vertical orientation and in frictional contact with the inside of the mouth of said container.

* * * * *